US012781740B2

(12) United States Patent
Feng et al.

(10) Patent No.: US 12,781,740 B2
(45) Date of Patent: Nov. 3, 2026

(54) SCROLL COMPRESSOR AND AIR CONDITIONING DEVICE

(71) Applicant: Hitachi-Johnson Controls Air Conditioning, Inc., Tokyo (JP)

(72) Inventors: Allen Feng, Tokyo (JP); Jason Peng, Tokyo (JP); Ben Ma, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 0 days.

(21) Appl. No.: 19/073,237

(22) Filed: Mar. 7, 2025

(65) Prior Publication Data

US 2025/0283466 A1 Sep. 11, 2025

(30) Foreign Application Priority Data

Mar. 7, 2024 (CN) ..... 202410264190.1

(51) Int. Cl.
*F04C 18/02* (2006.01)
*F04C 28/18* (2006.01)

(52) U.S. Cl.
CPC ..... *F04C 18/0215* (2013.01); *F04C 18/0261* (2013.01); *F04C 28/18* (2013.01)

(58) Field of Classification Search
CPC ... F04C 18/0215; F04C 18/0261; F04C 28/18
See application file for complete search history.

(56) References Cited

U.S. PATENT DOCUMENTS

| | | | | |
|---|---|---|---|---|
| 9,638,191 | B2 * | 5/2017 | Stover | F04C 18/0261 |
| 2016/0032924 | A1 * | 2/2016 | Stover | F04C 28/26 418/55.5 |
| 2018/0216618 | A1 * | 8/2018 | Jeong | F04C 28/26 |
| 2025/0347280 | A1 * | 11/2025 | Akei | F25B 1/04 |

* cited by examiner

*Primary Examiner* — Anthony Ayala Delgado
(74) *Attorney, Agent, or Firm* — MATTINGLY & MALUR, PC

(57) ABSTRACT

An end plate of a fixed scroll of a scroll compressor has a back pressure passage, at least two recesses and a plurality of bypass ports. The back pressure passage communicates a first fluid pocket of the two fluid pockets with a back pressure chamber, each of the bypass ports communicates one of the fluid pockets with one of the recesses, and a piston assembly of one of the capacity modulation structures is movably installed in each of the recesses. A radial distance between the back pressure passage and a center position of the fixed scroll wrap is smaller than a radial distance between each of the bypass ports communicating with the first fluid pocket, and the center position. In a capacity modulation mode, the back pressure passage provides appropriate back pressure for the back pressure chamber, to ensure stable operation of the scroll members.

10 Claims, 4 Drawing Sheets

SCROLL COMPRESSOR AND AIR CONDITIONING DEVICE

CROSS-REFERENCE TO RELATED APPLICATION

The present application claims priority from Chinese patent application CN 202410264190.1, filed on Mar. 7, 2024, the content of which is hereby incorporated by reference into this application.

TECHNICAL FIELD

The present application relates to the field of air conditioning technology, in particular to a scroll compressor and an air conditioning device.

BACKGROUND

A single-stage fixed-speed compressor has to stop operation under partial load, which will cause energy efficiency ratio (EER) performance penalty. To solve this problem, it is currently proposed to use an at least two-stage scroll compressor which will not be shut down under light load conditions, so as to achieve a higher EER than the single-stage compressor. Moreover, this at least two-stage scroll compressor has a lower cost than a variable speed compressor. However, existing scroll compressors having a capacity modulation function suffer from unstable scroll operation due to insufficient pressure in the back pressure chamber.

SUMMARY

Embodiments of the present application provide a scroll compressor and an air conditioning device, which solve the problem of the unstable scroll operation of the existing scroll compressors having the capacity modulation function due to the insufficient pressure in the back pressure chamber.

In order to achieve the above objective, in a first aspect, an embodiment of the present application provides a scroll compressor, including an orbiting scroll, a fixed scroll, and at least two capacity modulation structures, wherein:

An orbiting scroll wrap of the orbiting scroll intermeshes with a fixed scroll wrap of the fixed scroll to define two fluid pockets;

An end plate of the fixed scroll is provided with a back pressure passage, at least two recesses and a plurality of bypass ports, wherein the back pressure passage communicates a first fluid pocket of the two fluid pockets with a back pressure chamber, each of the bypass ports communicates one of the fluid pockets with one of the recesses, and a piston assembly of one of the capacity modulation structures is movably installed in each of the recesses;

A radial distance between the back pressure passage and a center position of the fixed scroll wrap is smaller than a radial distance between each of the bypass ports communicating with the first fluid pocket, and the center position.

Optionally, the end plate further comprises:

a plurality of fluid release passages, each extending radially from a first portion of one of the recesses through the end plate to an outer surface of the fixed scroll, and communicating with a suction pressure area or fluid injection way of the scroll compressor; and a plurality of switching passages, each extending radially from a second portion of one of the recesses through the end plate to the outer surface of the fixed scroll, and communicating with a valve assembly in the capacity modulation structure; wherein the first portion is a portion in the recess between the piston assembly and the fixed scroll wrap, and the second portion is a portion in the recess other than the first portion.

Optionally, when the switching passage communicates with the back pressure passage and a discharge passage of the fixed scroll through the valve assembly, a discharge pressure or back pressure force formed in the second portion pushes the piston assembly to a first position, and the bypass port is isolated from the fluid release passage. When the switching passage communicates with the suction pressure area through the valve assembly, gas in the fluid pocket pushes the piston assembly to a second position, and the bypass port communicates with the fluid release passage.

Optionally, the piston assembly includes a piston body and a first sealing component installed between the piston body and the recess, wherein the first sealing component is configured to isolate the fluid release passage from the switching passage.

Optionally, the end plate is provided with three of the bypass ports and two of the recesses. First and third bypass ports of the three bypass ports communicate with a first recess of the two recesses, and a second bypass port of the three bypass ports communicates with a second recess of the two recesses. The first bypass port communicates with the first fluid pocket, and the second and third bypass ports each communicate with a second fluid pocket, wherein the position of the first bypass port relative to the first fluid pocket is the same as the position of the second bypass port relative to the second fluid pocket.

Optionally, the end plate is provided with four of the bypass ports, of which first and fourth bypass ports communicate with the first fluid pocket, and second and third bypass ports communicate with a second fluid pocket.

Optionally, the second bypass port is disposed adjacent to the fourth bypass port, and the end plate is provided with two of the recesses. The first and third bypass ports each communicate with a first recess of the two recesses, the second and fourth bypass ports each communicate with a second recess of the two recesses, the first and fourth bypass ports each communicate with the first fluid pocket, and the second and third bypass ports each communicate with the second fluid pocket.

Optionally, the fourth bypass port is located away from the second bypass port, and the end plate is provided with three of the recesses. The first and third bypass ports communicate with a first recess of the three recesses, the second bypass port communicates with a second recess of the three recesses, and the fourth bypass port communicates with a third recess of the three recesses.

Optionally, the orbiting scroll wrap and the fixed scroll wrap are asymmetrical involute structures, wherein a total number of the bypass ports and the back pressure passage, which communicate with the first fluid pocket, is greater than or equal to the number of the bypass ports which communicate with the second fluid pocket.

In order to achieve the above objective, in a second aspect, an embodiment of the present application provides an air conditioning device, including the scroll compressor as described in the first aspect.

The beneficial effects of the above technical solutions in the present application are as follows.

The scroll compressor of the embodiments in the present application includes an orbiting scroll, a fixed scroll, and at least two capacity modulation structures, wherein an orbiting scroll wrap of the orbiting scroll intermeshes with a fixed scroll wrap of the fixed scroll to define two fluid pockets; an end plate of the fixed scroll is provided with a back pressure passage, at least two recesses and a plurality of bypass ports, wherein the back pressure passage communicates a first fluid pocket of the two fluid pockets with a back pressure chamber, each of the bypass ports communicates one of the fluid pockets with one of the recesses, and a piston assembly of one of the capacity modulation structures is movably installed in each of the recesses; wherein a radial distance between the back pressure passage and a center position of the fixed scroll wrap is smaller than a radial distance between each of the bypass ports communicating with the first fluid pocket, and the center position. In this way, by rationally arranging the back pressure passage, the back pressure passage is provided at an inner position (closer to the center position of the end plate in the radial direction) than all the bypass ports which communicate with the same fluid pocket. When the scroll compressor is in a capacity conversion mode, the back pressure passage inputs sufficient intermediate pressure gas into the back pressure chamber, so that the back pressure in the back pressure chamber is greater than a suction pressure but less than a discharge pressure when the scroll compressor is operating, thereby ensuring a stable operation of the orbiting scroll and improving its stability.

EXPLANATION OF REFERENCE SIGNS

101—orbiting scroll wrap, 201—fixed scroll wrap, 202—end plate, 203—back pressure passage, 204—recess, 2041—first recess, 2042—second recess, 2043—third recess, 205—fluid release passage, 206—switching passage, 301—first fluid pocket, 302—second fluid pocket, 401—piston body, 501—first bypass port, 502—second bypass port, 503—third bypass port, 504—fourth bypass port, 601—second seal, 602—floating sealing plate, 700—back pressure chamber.

DETAILED DESCRIPTION

In order to make the technical problem to be solved, technical solutions and advantages of the present application more apparent, a detailed description will be provided below in conjunction of the accompanying drawings and specific embodiments.

It should be understood that the term "one embodiment" or "an embodiment" mentioned throughout the specification means that specific features, structures or characteristics related to the embodiment are included in at least one embodiment of the present application. Therefore, the phrase "in one embodiment" or "in an embodiment" that appears throughout the specification does not necessarily refer to the same embodiment. In addition, these specific features, structures or characteristics may be combined in any suitable manner in one or more embodiments.

An embodiment of the present application provides a scroll compressor, as shown in FIGS. 1 to 7, which includes an orbiting scroll, a fixed scroll, and at least two capacity modulation structures. Here, the capacity modulation structures are used to modulate the capacity of the scroll compressor, enabling it to output different capacities without stopping the operation, which allows the scroll compressor to have higher EER performance. The orbiting scroll includes an end plate and an orbiting scroll wrap 101 extending towards the fixed scroll on one side of the end plate. The fixed scroll includes an end plate 202 and a fixed scroll wrap 201 extending towards the orbiting scroll on one side of the end plate 202. Specifically, the orbiting scroll is also referred to as an orbiting scroll plate, and the orbiting scroll wrap 101 is also referred to as an orbiting scroll body. Similarly, the fixed scroll is also referred to as a fixed scroll plate, and the fixed scroll wrap 201 is also referred to as a fixed scroll body.

Figure 1:
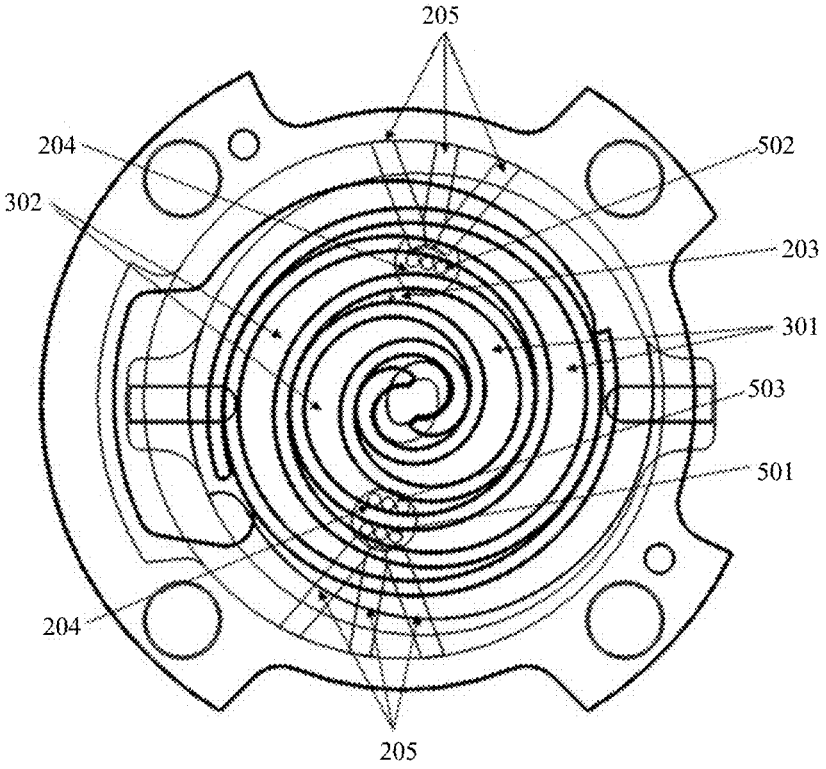
FIG. 1 is a first structural schematic diagram of a scroll compressor in an embodiment of the present application.

As shown in FIG. 1, the orbiting scroll wrap 101 of the orbiting scroll intermeshes with the fixed scroll wrap 201 of the fixed scroll to define two fluid pockets. Here, the two fluid pockets can move radially along with the rotation of the orbiting scroll wrap 101 relative to the fixed scroll wrap 201. Here, "radial" specifically refers to a radial direction of the end plate or the fixed scroll wrap 201. In addition, one of the fluid pockets is formed by a gap between an inner side of the orbiting scroll wrap 101 and an outer side of the fixed scroll wrap 201, such as a first fluid pocket 301 in FIG. 1, and the other fluid pocket is formed by a gap between an outer side of the orbiting scroll wrap 101 and an inner side of the fixed scroll wrap 201, such as a second fluid pocket 302 in FIG. 1.

Figure 2:
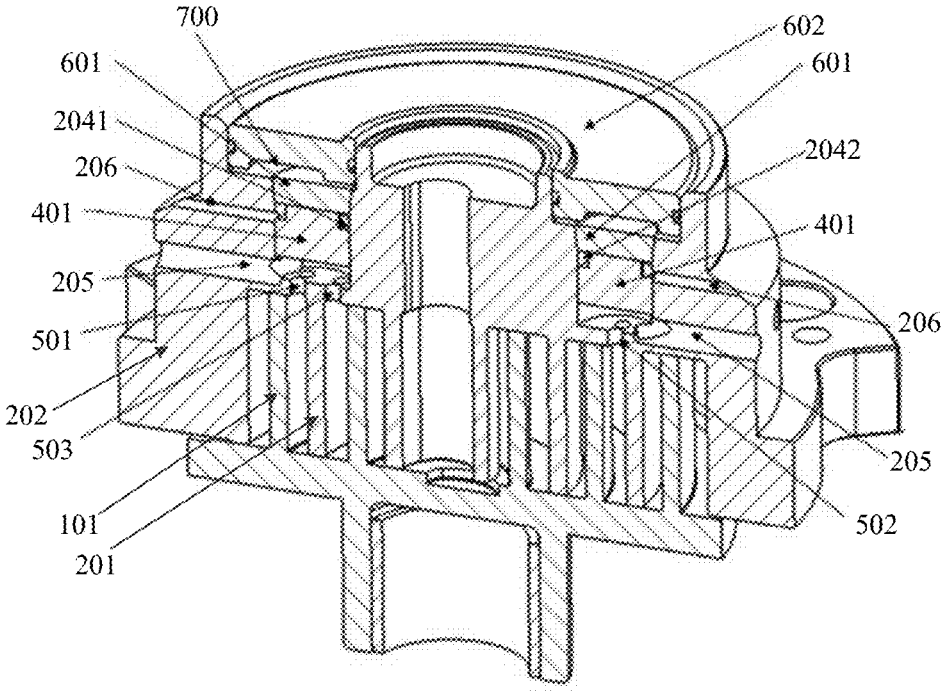
FIG. 2 is a sectional view of the scroll compressor in a minimal capacity mode in the embodiment of the present application.

As also shown in FIG. 1, the end plate 202 of the fixed scroll is provided with a back pressure passage 203, at least two recesses 204 and a plurality of bypass ports, such as a first bypass port 501, a second bypass port 502 and a third bypass port 503 in FIG. 1. The back pressure passage 203 communicates the first fluid pocket 301 of the two fluid pockets with a back pressure chamber 700 (a back pressure chamber 700 is shown in FIG. 2). As shown in FIG. 1, each of the bypass ports communicates one of the fluid pockets with one of the recesses 204. Further, as shown in FIG. 2, a piston assembly of one of the capacity modulation structures is movably installed within each of the recesses 204, such as a first recess 2041 and a second recess 2041 in FIG. 2.

Figure 3:
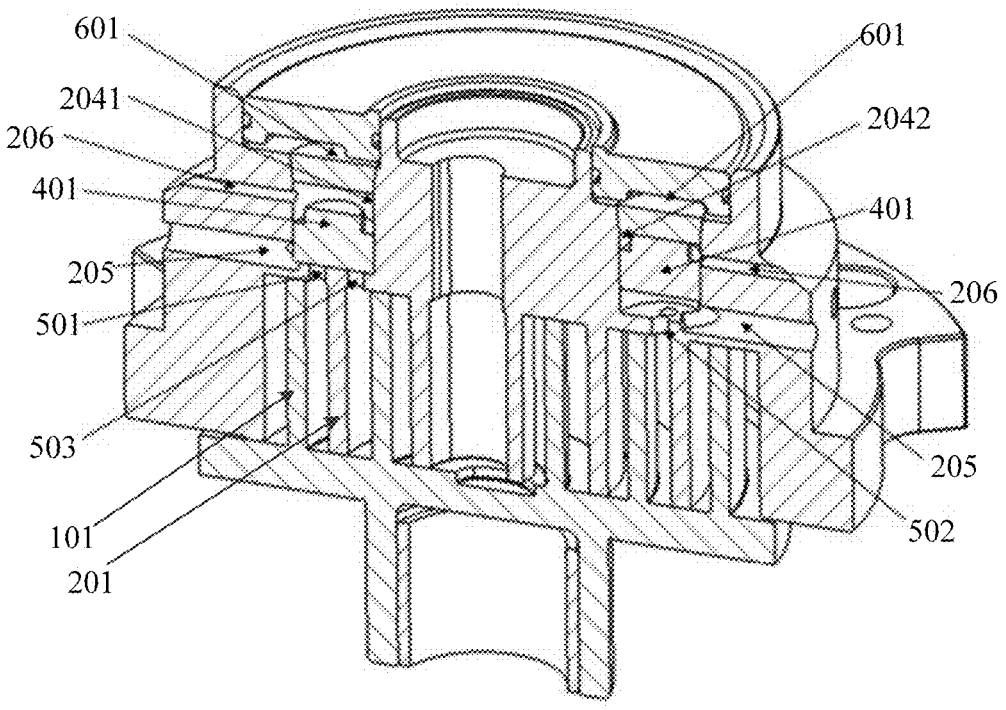
FIG. 3 is a sectional view of the scroll compressor in an intermediate capacity mode in the embodiment of the present application.
Figure 4:
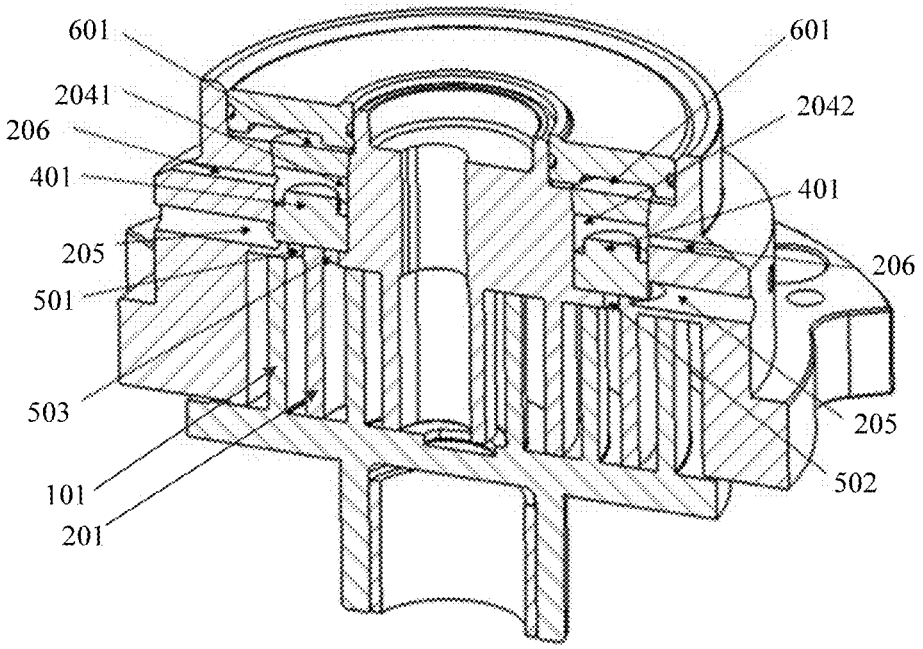
FIG. 4 is a sectional view of the scroll compressor in a maximal capacity mode in the embodiment of the present application.

Here, relevant structures of the recesses 204 and the back pressure chamber 700 will be described in detail. The individual recesses 204 are recesses independent of each other. Specifically, as shown in FIGS. 2 to 4, an upper surface of the end plate (a surface facing away from the fixed scroll wrap 201) is provided with an annular groove. A plurality of independent recesses 204 are formed by extending downwardly at different positions at a bottom of the annular groove. A second seal 601 is installed between each of the recesses 204 and the annular groove to prevent communication between each of the recesses 204 and the annular groove. In addition, a floating sealing plate 602 is installed inside the annular groove, and the back pressure chamber 700 is formed between the floating sealing plate and the second seal 601.

Specifically, a radial distance between the back pressure passage 203 and a center position of the fixed scroll wrap 201 is smaller than a radial distance between each of the bypass ports communicating with the first fluid pocket 301, and the center position. That is to say, for the back pressure passage 203 and each bypass port, which communicate with the first fluid pocket 301, the back pressure passage 203 is located radially inward (closer to the center position) relative to all the bypass ports. In this way, it is possible to prevent the pressure in the back pressure passage 203 from being unloaded through the various bypass ports, ensuring that an appropriate pressure of gas is always provided for the back pressure chamber 700 through the communication between the back pressure chamber 700, the back pressure passage 203 and the first fluid pocket 301, so that the back pressure in the back pressure chamber 700 is greater than the suction pressure but less than the discharge pressure when the scroll compressor is operating, thereby achieving the stable operation of the orbiting scroll.

In the scroll compressor of the embodiment of the present application, the orbiting scroll wrap 101 intermeshes with the fixed scroll wrap 201 to define a first fluid pocket 301 and a second fluid pocket 302 between them. The capacity modulation of the scroll compressor is achieved by moving the piston assembly of the capacity modulation structure within the recess 204 to adjust the capacity of the scroll compressor. In addition, in the embodiment of the present application, the back pressure passage 203 is disposed at an inner position than all the bypass ports which communicate with the same fluid pocket, so that the back pressure passage 203 can always provide a suitable capacity of gas for the back pressure chamber 700 in the capacity modulation mode of the scroll compressor, so as to achieve that the back pressure in the back pressure chamber 700 is always greater than the suction pressure but less than the discharge pressure when the scroll compressor is operating, thereby ensuring the stable operation of the orbiting scroll. As a result, the problem of the unstable operation of the orbiting scroll due to the inhalation of the gas in the fluid pocket into the bypass in the capacity modulation mode is solved, and the stability of the orbiting scroll is improved.

Further, as an optional implementation, the end plate 202 is further provided with a plurality of fluid release passages 205 (as shown in FIGS. 1 and 2), each extending radially from a first portion of one of the recesses 204 through the end plate 202 to an outer surface of the fixed scroll, and communicating with a suction pressure area of the scroll compressor; and a plurality of switching passages 206 (as shown in FIG. 2), each extending radially from a second portion of one of the recesses 204 through the end plate 202 to the outer surface of the fixed scroll, and communicating with a valve assembly in the capacity modulation structure. The valve assembly may be a solenoid valve assembly or any other suitable valve type. Here, a controller (not shown in the figures) for the scroll compressor may control the movement of the piston assembly within the recess 204 through controlling the operation of the valve assembly. Specifically, the controller may choose a solenoid reversing valve. Optionally, the controller may control the valve assembly by means of pulse width modulation.

The first portion is a portion in the recess 204 between the piston assembly and the fixed scroll wrap 201, and the second portion is a portion in the recess 204 other than the first portion. Taking FIG. 2 as an example, the first portion is a portion in the recess 204 located below the piston assembly, and the second portion is a portion in the recess 204 located above the piston assembly (a portion between the piston assembly and the second seal 601).

On the basis of the above optional implementation, specifically, when the switching passage 206 communicates with a discharge passage or the back pressure passage 203 of the fixed scroll through the valve assembly, a discharge pressure or back pressure force formed in the second portion pushes the piston assembly to a first position, and the bypass port is isolated from the fluid release passage 205. In this way, the gas inhaled into the fluid pocket cannot be inhaled into the bypass through the bypass port, and the gas discharge amount of the scroll compressor is relatively large, and the scroll compressor is in a high capacity mode. That is to say, when the switching passage 206 communicates with the discharge passage or the back pressure passage 203, the discharge pressure or the back pressure force formed in the second portion is greater than the suction pressure formed in the first portion. Therefore, the discharge pressure or the back pressure force pushes the piston assembly to the first position. In addition, it should be noted that the pressure in the discharge passage is also greater than the pressure in the back pressure chamber 700 communicating with the back pressure passage 203.

When the switching passage 206 communicates with the suction pressure area through the valve assembly, the gas in the fluid pocket pushes the piston assembly to a second position, and the bypass port communicates with the fluid release passage 205. In this way, the gas inhaled into the fluid pocket may be inhaled into the bypass through the bypass port to reduce the gas discharge amount of the scroll compressor, so that the scroll compressor in a low capacity mode.

Below, the structure and working process related to the capacity modulation structure will be explained.

Here, it should be noted that each valve assembly includes a first way, a second way and a third way, wherein the first way communicates with the suction pressure area of the scroll compressor, the second way communicates with the second portion of the recess 204 through the switching passage 206, and the third way communicates with a discharge passage or back pressure passage formed by a central hole of the end plate 202 through other passages (not shown in the figures) provided in the end plate 202. In addition, the fluid release passage 205 communicating with the first portion of the recess 204 communicates with the suction pressure area of the scroll compressor.

Specifically, when the first and second ways of the valve assembly are in communication with each other and isolated from the third way, the second portion of the recess 204 in the end plate 202 communicates with the suction pressure area through the switching passages 206, the first way, and the second way. At this time, the gas inhaled into the fluid pocket flows to the recess 204 through the bypass port, driving the piston assembly in the recess 204 to move upward to a second position (such as the positions of the piston assemblies in FIG. 2, or the position of the piston assembly on the right side in FIG. 3), and the bypass port communicates with the fluid release passage 205. The gas inhaled into the fluid pocket is thus inhaled into the bypass through the bypass port, so that the scroll compressor discharges reduced gas, and is in a low capacity mode.

When the second and third ways of the valve assembly are in communication with each other and isolated from the first way, the second portion of the recess 204 in the end plate 202 communicates with the discharge passage or the back pressure passage via the switching passages 206, the second way, the third way, and other passages not shown in the previous figures. At this time, the discharge pressure or back pressure force in the second portion of the recess 204 pushes the piston assembly to move downwardly to the first position (such as the positions of the piston assemblies in FIG. 4, or the position of the piston assembly on the left side in FIG. 3), and the bypass port is isolated from the fluid release passage 205. The gas inhaled into the fluid pocket thus cannot be inhaled into the bypass through the bypass port, so that the scroll compressor discharges a large amount of gas and is in the high capacity mode.

On the basis of the above working process, if the scroll compressor includes two capacity modulation structures, the capacity mode of the scroll compressor will include the following three situations: a first situation as shown in FIG. 2, in which both piston assemblies are in the second position, all the bypass ports are in communication with the fluid release passages 205, and the scroll compressor has the minimal displacement and provides the minimal capacity mode; a second situation as shown in FIG. 3, in which one of the piston assemblies is in the first position (the piston assembly on the left side in FIG. 3), and the other one of the piston assemblies is in the second position (the piston assembly on the right side in FIG. 3), and at this time, the first and third bypass ports 501, 503 are isolated from the respective fluid release passages 205, the second bypass port 502 is in communication with the respective fluid release passage 205, and part of the gas inhaled into the second fluid pocket 302 communicating with the second bypass port 502 is bypassed though the second bypass port 502, so that the scroll compressor has an increased displacement as compared with that of the scroll compressor in the state of FIG. 2, and provides an intermediate capacity mode; and a third situation as shown in FIG. 4, in which both piston assemblies are in the first position, and all the bypass ports are isolated from the fluid release passages 205, so that the scroll compressor has a maximal displacement and provides the maximal capacity mode.

As a specific implementation, the piston assembly includes a piston body 401 and a first sealing component installed between the piston body 401 and the recess 204. The first sealing component is used to isolate the fluid release passage 205 from the switching passage 206. Specifically, the piston body 401 includes a first cylindrical portion having a small diameter and a second cylindrical portion having a large diameter. The first cylindrical portion is disposed coaxially with, and located above the second cylindrical portion (as shown in FIG. 2, the section of the piston body 401 has a shape of a character "凵"). The first sealing component is installed in a gap between an outer surface of the second cylindrical portion of the piston body 401 and an inner surface of the recess 204. Here, the first sealing component is, for example, a sealing ring, and can be fitted onto a side surface of the second cylindrical portion. Furthermore, the first sealing component has a thickness which is adapted to a gap between the first cylindrical portion and the recess 204. In this way, it is possible to achieve the sealing of the gap between the second cylindrical portion and the recess 204 using the first sealing component, in order to avoid the communication between the switching passage 206 and the fluid release passage 205 though the gap between the recess 204 and the piston body 410, and achieve the purpose of completely isolating the switching passage 206 from the fluid release passage 205.

As a specific implementation, as shown in FIG. 1, the end plate 202 is provided with three of the bypass ports and with two of the recesses 204. As shown in FIG. 2, first and third bypass ports 501, 503 communicate with a first recess 2041, and a second bypass port 502 communicates with a second recess 2042; the first bypass port 501 communicates with the first fluid pocket 301, and the second and third bypass ports 502, 503 each communicate with the second fluid pocket 302, wherein the position of the first bypass port 501 relative to the first fluid pocket 301 is the same as that of the second bypass port 502 relative to the second fluid pocket 302. In this way, it is possible to achieve the same pressure in the first and second fluid pockets, thereby making the scroll operation more stable.

Here, it should be noted that each of the bypass ports communicates with a corresponding fluid pocket at different radial positions on the end plate. Since only one of the bypass ports (the first bypass port 501) and the back pressure passage 203 communicate with the same fluid pocket (the first fluid pocket 301), the back pressure passage 203 is disposed at a radially inner position (i.e., closer to the center position of the end plate 202) relative to the position of the first bypass port 501, when designing the position of the back pressure passage 203.

Figure 5:
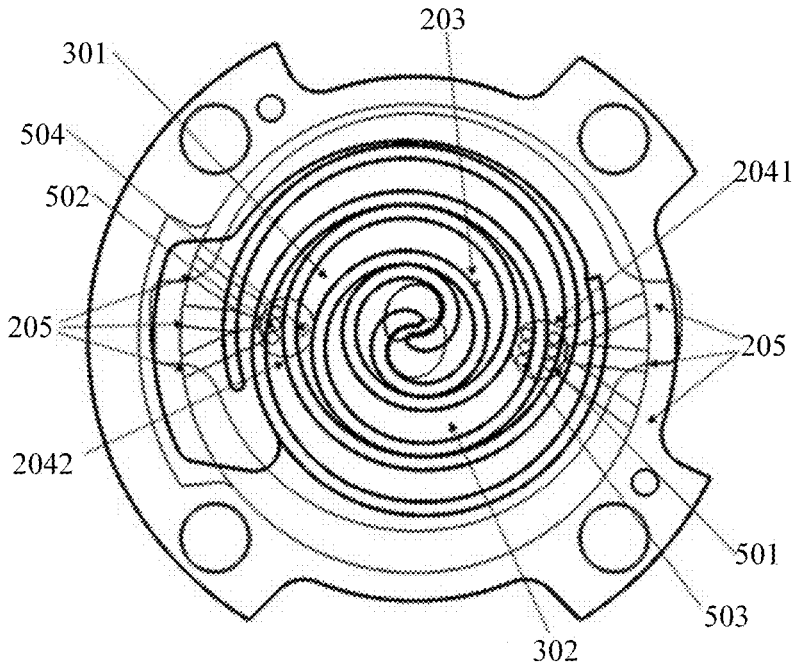
FIG. 5 is a second structural schematic diagram of the scroll compressor in an embodiment of the present application.
Figure 6:
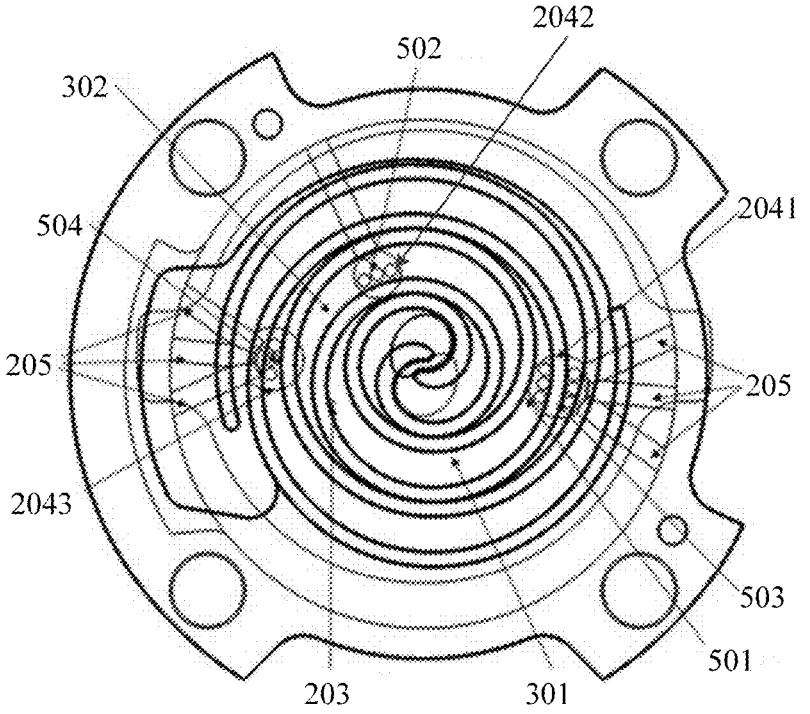
FIG. 6 is a third structural schematic diagram of the scroll compressor in an embodiment of the present application.
Figure 7:
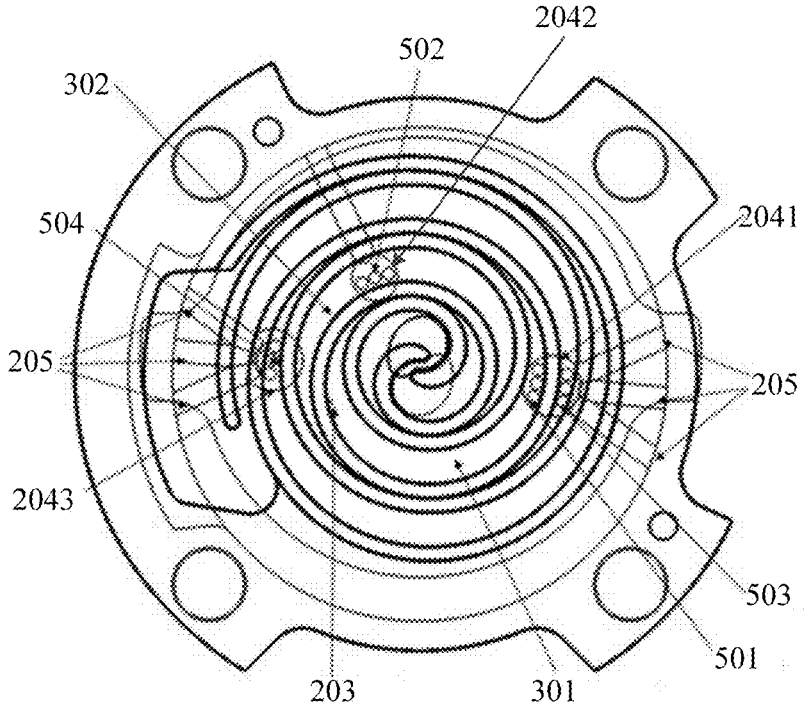
FIG. 7 is a fourth structural schematic diagram of the scroll compressor in an embodiment of the present application.

As another optional implementation, as shown in FIGS. 5, 6, and 7, the end plate 202 is provided with four bypass ports, of which first and fourth bypass ports 501, 504 communicate with the first fluid pocket, and second and third bypass ports 502, 503 communicate with the second fluid pocket 302. In this way, it is possible to flexibly adjust the capacity of the scroll compressor, so as to make the scroll compressor have a lower capacity mode or a wider variety of capacity modes.

As a specific implementation on the basis of the above optional implementations, as shown in FIG. 5, the second bypass port 502 is disposed adjacent to the fourth bypass port 504, and the end plate 202 is provided with two of the recesses 204. The first and third bypass ports 501, 503 each communicate with a first recess 2041 of the two recesses 204, and the second and fourth bypass ports 502, 504 each communicate with a second recess 2042 of the two recesses 204, the first and fourth bypass ports 501, 504 each communicate with the first fluid pocket 301, and the second and third bypass ports 502, 503 each communicate with the second fluid pocket 302.

Here, it should be noted that, as shown in FIG. 5, the first bypass port 501, the fourth bypass ports 504 and the back pressure passage 203 each communicate with the first fluid pocket 301, and in the radial direction, the fourth bypass port 504 is located at an inner position than the first bypass port 501, and the backpressure passage 203 is thus located at an inner position than the fourth bypass port 504.

In this specific implementation, a fourth bypass port 504 including at least one hole has been added, and the second and fourth bypass ports 502, 504 are controlled by the same piston assembly to communicate with or isolate from the corresponding fluid release passages 205, so that more gas flows into the bypass from the second and fourth bypass ports 502, 504 than from the second bypass port 502 only. In this way, it is possible to achieve a lower capacity ratio of the scroll compressor. Here, it should be noted that, the switching processes of the scroll compressor in the different capacity modes in this specific implementation are the same as those of the scroll compressor in the different capacity modes corresponding to FIGS. 1 to 4, and will not be repeated here.

As a specific implementation on the basis of the above optional implementations, as shown in FIGS. 6 and 7, the fourth bypass port 504 is disposed at a position away from the second bypass port 502, and the end plate 202 is provided with three of the recesses 204. The first and third bypass ports 501, 503 communicate with a first recess 2041 of the three recesses, the second bypass port 502 communicates with a second recess 2042 of the three recesses, and the fourth bypass port 504 communicates with a third recess 2043 of the three recesses.

In this specific implementation, by providing three recesses 204 on the end plate 202, the bypass ports can be controlled by three piston assemblies to communicate with or isolate from the corresponding fluid release passages. In this way, the scroll compressor can achieve 4-stage capacity modulation.

Specifically, when all the piston assemblies are in the first position, all the bypass ports are isolated from the corresponding fluid release passages, and the scroll compressor has a maximal capacity.

When the piston assemblies in the first and second recesses 2041, 2042 are in the first position, and the piston assembly in the third recess 2043 is in the second position, the first, third and second bypass ports 501, 503, 502 are each isolated from the corresponding fluid release passages, and the fourth bypass port 504 is in communication with the corresponding fluid release passage, and the scroll compressor provides a second capacity.

When the piston assembly in the second recess 2042 is in the first position, and the piston assemblies in the first and third recesses 2041, 2043 are in the second position, the first, fourth and third bypass ports 501, 504, 503 are each in communication with the corresponding fluid release passages, the second bypass port 502 is isolated from the corresponding fluid release passage, and the scroll compressor provides a third capacity which is smaller than the second capacity.

When all the piston assemblies are in the second position, all the bypass ports are in communication with the corresponding fluid release passages, and the scroll compressor has a minimal capacity As an optional implementation, the orbiting scroll wrap 101 and the fixed scroll wrap 102 are asymmetrical involute structures (as shown in FIG. 7). Furthermore, a total number of the back pressure passage 203 and the bypass ports, which communicate with the first fluid pocket 301, is greater than or equal to the number of the bypass ports which communicate with the second fluid pocket 302. Taking FIG. 7 as an example, the first fluid pocket 301 is an outer pocket of the scroll compressor, and the second fluid pocket 302 is an inner pocket of the scroll compressor, and the first fluid pocket 301 here has a longer compression passage than the second fluid pocket 302. As compared to arranging the back pressure passage 203 in the second fluid pocket 302, arranging the back pressure passage 203 in the first fluid pocket 301 can make the back pressure passage 203 further away from the bypass ports/discharge ports, thereby allowing the back pressure chamber 700 to obtain more stable back pressure and ensuring the stable scroll operation.

Here, it should be noted that, as shown in FIG. 7, the first bypass port 501, the fourth bypass ports 504 and the back pressure passage 203 each communicate with the first fluid pocket 301, and in a radial direction, the first bypass passage 501 is located at an inner position than the fourth bypass port 504, and the back pressure passage 203 is thus located at an inner position than the first bypass port 501. That is, relative to the first and fourth bypass ports 501, 504, the back pressure passage 203 is located closer to the center position in the radial direction.

In this optional implementation, the orbiting scroll wrap 101 and the fixed scroll wrap 201 are provided as asymmetrical involute structures, which can increase the volume of the fluid pockets and enhance the maximal capacity of the scroll compressor, as compared with the symmetrical orbiting scroll wrap 101 and fixed scroll wrap 201.

Embodiments of the present application further provide an air conditioning device including the scroll compressor as described above. The air conditioning device can achieve all the technical effects of the above scroll compressor, which will not be repeated here.

The above are preferred embodiments of the present application. It should be noted that for those having ordinary skills in the art, without departing from the principles described in the present application, several improvements and embellishments can be made, which should also be considered to fall within the scope of protection of the present application.

What is claimed is:

1. A scroll compressor, having an orbiting scroll, a fixed scroll, and at least two capacity modulation structures, scroll compressor comprising:

an orbiting scroll wrap of the orbiting scroll intermeshes with a fixed scroll wrap of the fixed scroll to define two fluid pockets; and an end plate of the fixed scroll is provided with a back pressure passage, at least two recesses and a plurality of bypass ports, wherein the back pressure passage communicates a first fluid pocket of the two fluid pockets with a back pressure chamber, each of the bypass ports communicates one of the fluid pockets with one of the recesses, wherein a piston assembly of one of the capacity modulation structures is movably installed in each of the recesses, and wherein a radial distance between the back pressure passage and a center position of the fixed scroll wrap is smaller than a radial distance between each of the bypass ports communicating with the first fluid pocket, and the center position.

2. The scroll compressor according to claim 1, wherein the end plate further comprises:

a plurality of fluid release passages, each extending radially from a first portion of one of the recesses through the end plate to an outer surface of the fixed scroll, and communicating with a suction pressure area of the scroll compressor; and a plurality of switching passages, each extending radially from a second portion of one of the recesses through the end plate to the outer surface of the fixed scroll, and communicating with a valve assembly in the capacity modulation structure, wherein the first portion is a portion in the recess between the piston assembly and the fixed scroll wrap, and the second portion is a portion in the recess other than the first portion.

3. The scroll compressor according to claim 2, wherein when the switching passage communicates with a discharge passage or the back pressure passage of the fixed scroll through the valve assembly, a discharge pressure or back pressure force formed in the second portion pushes the piston assembly to a first position, and the bypass port is isolated from the fluid release passage, and wherein when the switching passage communicates with the suction pressure area through the valve assembly, gas in the fluid pocket pushes the piston assembly to a second position, and the bypass port communicates with the fluid release passage.

4. The scroll compressor according to claim 2, wherein the piston assembly comprises a piston body and a first sealing component installed between the piston body and the recess, and wherein the first sealing component is configured to isolate the fluid release passage from the switching passage.

5. The scroll compressor according to claim 1, wherein the end plate is provided with three of the bypass ports and two of the recesses, wherein first and third bypass ports communicate with a first recess, and a second bypass port communicates with a second recess;

wherein the first bypass port communicates with the first fluid pocket, and the second and third bypass ports each communicate with a second fluid pocket, and wherein the position of the first bypass port relative to the first fluid pocket is the same as the position of the second bypass port relative to the second fluid pocket.

6. The scroll compressor according to claim 1, wherein the end plate is provided with four of the bypass ports, of which first and fourth bypass ports communicate with the first fluid pocket, and second and third bypass ports communicate with a second fluid pocket.

7. The scroll compressor according to claim 6, wherein the second bypass port is disposed adjacent to the fourth bypass port, and the end plate is provided with two of the recesses, wherein the first and third bypass ports each communicate with a first recess, the second and fourth bypass port each communicate with a second recess, the first and fourth bypass ports each communicate with the first fluid pocket, and the second and third bypass ports each communicate with the second fluid pocket.

8. The scroll compressor according to claim 6, wherein the fourth bypass port is located away from the second bypass port, and the end plate (202) is provided with three of the recesses, and wherein the first and third bypass ports communicate with a first recess, the second bypass port communicates with a second recess, and the fourth bypass port communicates with a third recess.

9. The scroll compressor according to claim 1, wherein the orbiting scroll wrap and the fixed scroll wrap are asymmetrical involute structures, and wherein a total number of the bypass ports and the back pressure passages, which communicate with the first fluid pocket, is greater than or equal to the number of the bypass ports which communicate with the second fluid pocket.

10. An air conditioning device comprising the scroll compressor as claimed in claim 1.

* * * * *